US009086245B2

(12) United States Patent
Kitazawa et al.

(10) Patent No.: US 9,086,245 B2
(45) Date of Patent: Jul. 21, 2015

(54) HEAT EXCHANGER

(75) Inventors: Masaaki Kitazawa, Kusatsu (JP); Shigeharu Taira, Kusatsu (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 2224 days.

(21) Appl. No.: 11/791,540

(22) PCT Filed: Nov. 22, 2005

(86) PCT No.: PCT/JP2005/021420

§ 371 (c)(1), (2), (4) Date: May 24, 2007

(87) PCT Pub. No.: WO2006/057233

PCT Pub. Date: Jun. 1, 2006

(65) Prior Publication Data

US 2008/0006397 A1 Jan. 10, 2008

(30) Foreign Application Priority Data

Nov. 25, 2004 (JP) ..... 2004-340326

(51) Int. Cl.

| | |
|---|---|
| ***F28B 1/00*** | (2006.01) |
| ***F28D 1/04*** | (2006.01) |
| ***F28D 1/02*** | (2006.01) |
| ***F28F 17/00*** | (2006.01) |
| ***F24F 1/00*** | (2011.01) |
| ***F28F 1/32*** | (2006.01) |

(52) U.S. Cl.
CPC ..... *F28F 17/005* (2013.01); *F24F 1/0059* (2013.01); *F28F 1/32* (2013.01)

(58) Field of Classification Search
CPC ..... F28F 17/005; F28F 1/32; F24F 1/0059
USPC ..... 165/140, 171, 172
See application file for complete search history.

(56) References Cited

U.S. PATENT DOCUMENTS

| | | | | |
|---|---|---|---|---|
| 4,173,998 | A | 11/1979 | Jahoda | |
| 4,877,087 | A * | 10/1989 | Hill | 165/181 |
| 4,996,950 | A * | 3/1991 | Le Mer | 122/260 |
| 5,954,125 | A * | 9/1999 | Mantegazza et al. | 165/149 |
| 6,050,328 | A * | 4/2000 | Shikazono et al. | 165/121 |
| 6,273,182 | B1 * | 8/2001 | Pautler et al. | 165/67 |
| 2003/0102112 | A1 * | 6/2003 | Smithey et al. | 165/150 |
| 2004/0003915 | A1 * | 1/2004 | Shippy et al. | 165/151 |

FOREIGN PATENT DOCUMENTS

| | | | |
|---|---|---|---|
| JP | 57-56673 | B2 | 12/1982 |
| JP | 5-346274 | A | 12/1993 |
| JP | 6-347186 | A | 12/1994 |
| JP | 2003-275836 | A | 9/2003 |

* cited by examiner

*Primary Examiner* — Allana Lewin Bidder
*Assistant Examiner* — Dawit Muluneh
(74) *Attorney, Agent, or Firm* — Birch, Stewart, Kolasch & Birch, LLP

(57) ABSTRACT

A heat exchanger includes an auxiliary heat exchanger, which has plate-shaped first fins and a plurality of first heat transfer tubes, and a main heat exchanger which has plate-shaped second fins and a plurality of second heat transfer tubes. A plurality of burrs are present at specified intervals on edges of the first fins. The auxiliary heat exchanger and the main heat exchanger are so positioned that the edges of the first fins on which the burrs are present are in contact with edges of the second fins, and the edges having the burrs present thereon are positioned on the inner side.

11 Claims, 2 Drawing Sheets

HEAT EXCHANGER

CROSS-REFERENCE TO RELATED APPLICATIONS

This U.S. national stage application claims priority under 35 U.S.C. §119(a) to Japanese Patent Application No. 2004-340326 filed in Japan on Nov. 25, 2004, the entire contents of which are hereby incorporated by reference.

TECHNICAL FIELD

The present invention relates to a heat exchanger. More particularly, the invention relates to a heat exchanger suitable for use in air conditioners, refrigerators, ice makers and the like.

BACKGROUND ART

Conventionally, there has been a heat exchanger formed by dividing perforated fins, which have perforations formed therein, at their perforations. More specifically, this heat exchanger is formed by inserting heat transfer tubes into insertion holes of a perforated fin and then separating the fin at the perforations so that two heat exchangers are formed.

The conventional heat exchanger shown above, in which the fins can be separated at the places of the perforations, is easy to manufacture, having an advantage that heat exchangers of different dimensions can be easily manufactured by separating the fins at the perforations or not separating the fins at the perforations but leaving the perforations as they are.

However, the above conventional heat exchanger, while having an advantage of easiness in changing dimensional settings of the fins, has a problem that because, in division of the fins, burrs are formed on an outer edge of the heat exchanger formed by dividing the perforated fins at the perforations and corresponding to places of the fins where the perforations have been separated, condensed water (dew drop water) generated on the fins during the use of the heat exchanger may scatter from the fins along the burrs. In particular, when the conventional heat exchanger is used as a heat exchanger on the indoor side of an air conditioner, the condensed water may be scattered indoors by air blows, giving rise to a serious problem.

Further, in the conventional heat exchanger, since the edge on which the burrs are present is positioned at an outer edge of the heat exchanger, there is another problem that the appearance of the heat exchanger is impaired.

SUMMARY OF THE INVENTION

Accordingly, an object of the present invention is to provide a heat exchanger which is easy to change in dimensional settings of its fins and which is less liable to scattering of condensed water from the fins and moreover which is kept from impairment of its appearance.

In order to achieve the above object, the present invention provides a heat exchanger comprising:

a first heat exchanger section having plate-shaped first fins, and a plurality of first heat transfer tubes inserted through the first fins so as to extend along a thicknesswise direction of the first fins; and a second heat exchanger section having plate-shaped second fins, and a plurality of second heat transfer tubes inserted through the second fins so as to extend along a thicknesswise direction of the second fins, wherein a plurality of burrs are present at specified intervals on edges of the first fins and/or the second fins, and the first heat exchanger section and the second heat exchanger section are so positioned that edges of the first fins or the second fins on which the burrs are present are in contact with or opposition to the other edges of the first fins or the second fins, where the edges having the burrs present thereon are positioned on an inner side.

In the heat exchanger of this invention, edges with burrs present thereon in the first fins or the second fins are so positioned as to be in contact with or opposition to the other edges of the first fins or the second fins, and the edges with the burrs present thereon are positioned inside. Therefore, burrs are present only on the edges that are in contact with or opposition to the second fins, and not on the other edges, among all the edges of the first fins, and moreover burrs are present only on the edges that are in contact with or opposition to the first fins, and not on the other edges, among all the edges of the second fins.

Consequently, even if condensed water has scattered from the edges having the burrs thereon, the scattered condensed water can be received by the edges that are in contact with or opposition to the edges having the burrs thereon. Thus, since condensed water can be prevented from scattering outside along with winds, the heat exchanger of the invention, even when used as a heat exchanger on the indoor side of an air conditioner, can be kept from indoor scattering of the condensed water mixed in winds.

Also, in the heat exchanger of this invention, edges with burrs present thereon in the first fins or the second fins are so positioned as to be in contact with or opposition to the other edges of the first fins or the second fins, and the edges with the burrs present thereon are positioned inside. Therefore, burrs are present only on the edges that are in contact with or opposition to the second fins, and not on the other edges, among all the edges of the first fins, and moreover burrs are present only on the edges that are in contact with or opposition to the first fins, and not on the other edges, among all the edges of the second fins. Since the edges having the burrs thereon are never positioned on the outer side of the heat exchanger, the heat exchanger can be kept from impairment of its appearance.

Also, in the heat exchanger of this invention, edges with burrs present thereon in the first fins or the second fins are so positioned as to be in contact with or opposition to the other edges of the first fins or the second fins, and the edges with the burrs present thereon are positioned inside. Therefore, even if condensed water has scattered from the edges having the burrs thereon, the scattered condensed water can be received by the edges that are in contact with or opposition to the edges having the burrs thereon. Thus, since condensed water can be prevented from scattering outside along with winds, the heat exchanger of the invention, even when used as a heat exchanger on the indoor side of an air conditioner, can be kept from indoor scattering of the condensed water mixed in winds.

Further, in the heat exchanger of this invention, since the edges having the burrs thereon are never positioned on the outer side of the heat exchanger, the heat exchanger can be kept from impairment of its appearance.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the present invention will be described in detail by embodiments thereof illustrated in the accompanying drawings.

Figure 1:
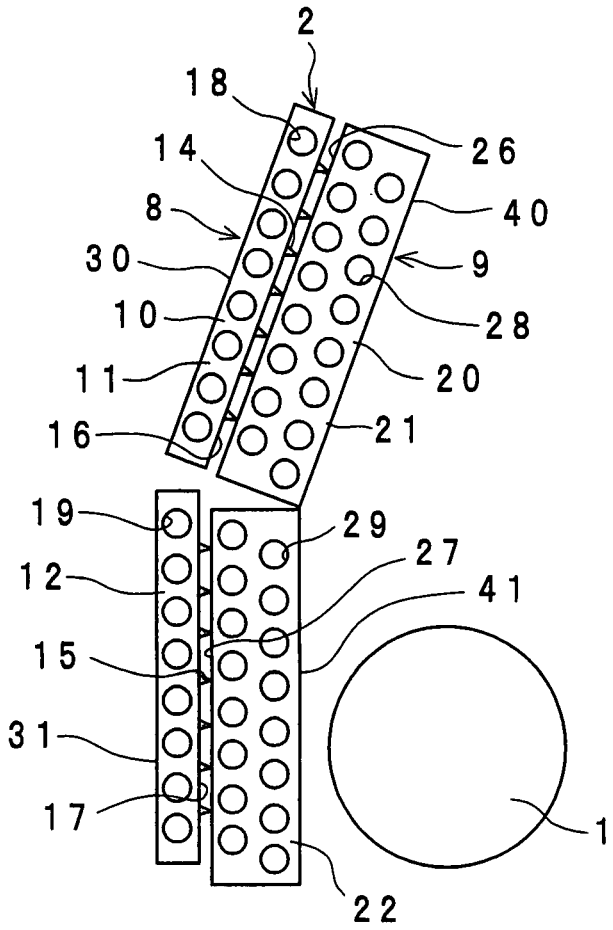
FIG. 1 is a schematic sectional view of an air conditioner which uses a heat exchanger according to one embodiment of the present invention.

FIG. 1 is a schematic sectional view of an air conditioner which uses a heat exchanger according to one embodiment of the invention. In FIG. 1, reference numeral 1 denotes a blower fan, and 2 denotes a heat exchanger. In FIG. 1, a casing or the like in which the blower fan 1 and the heat exchanger 2 are housed is omitted for simplicity's sake.

This air conditioner is so designed that the blower fan 1 is rotated to blow out air, which serves as a heat transfer medium sucked in via the heat exchanger 2, through an unshown blowoff opening.

The heat exchanger 2 has an auxiliary heat exchanger 8 as an example of a first heat exchanger section, and a main heat exchanger 9 as an example of a second heat exchanger section.

The auxiliary heat exchanger 8 has sheet-like first fins 10, and unshown first heat transfer tubes. The first fin 10, as shown in FIG. 1, has a generally long-and-narrow rectangular-shaped surface. The first fin 10 is provided in plurality so as to be disposed at specified intervals along a thicknesswise direction of the first fin 10 (a direction perpendicular to the drawing sheet of FIG. 1).

The first fin 10 is composed of a first portion 11 having a long-and-narrow rectangular-shaped surface, and a second portion 12 generally identical in shape to the first portion 11. In the first portion 11 are formed 1-row, 8-stage through holes 18 for insertion of heat transfer tubes. Similarly, 1-row, 8-stage through holes 19 for insertion of heat transfer tubes are formed in the second portion 12. Further, burrs 14 are formed at specified intervals on a longitudinal one-side edge of the first portion 11, while burrs 15 are formed at specified intervals on a longitudinal one-side edge of the second portion 12.

The first heat transfer tubes are inserted into the 1-row, 8-stage through holes 18 of the first portion 11 for insertion of heat transfer tubes, as well as into the 1-row, 8-stage through holes 19 of the second portion 12 for insertion of heat transfer tubes. More specifically, the first heat transfer tubes are so placed as to run through a plurality of first fins 10 arrayed at specified intervals in a thicknesswise direction of the first fins.

One corner at longitudinal one end of the first portion 11 on which the burrs 14 are formed, and one corner at longitudinal one end of the second portion 12 on which the burrs 15 are formed, are in proximity to each other. The second portion 12 is so positioned so as to adjoin the longitudinal one end of the first portion 11. The second portion 12 is so positioned as to be slightly inclined with respect to the first portion 11.

The main heat exchanger 9 has sheet-like second fins 20 and unshown second heat transfer tubes. The second fin 20, as shown in FIG. 1, has a generally long-and-narrow rectangular-shaped surface. The second fin 20 is provided in plurality so as to be disposed at specified intervals along a thicknesswise direction of the second fin 20 (a direction perpendicular to the drawing sheet of FIG. 1).

The second fin 20 is composed of a first portion 21 having a long-and-narrow rectangular-shaped surface, and a second portion 22 generally identical in shape to the first portion 21. In the first portion 21 are formed 2-row, 8-stage through holes 28 for insertion of heat transfer tubes. Similarly, 2-row, 8-stage through holes 29 for insertion of heat transfer tubes are formed in the second portion 22. The first portion 21 of the second fin 20, the second portion 22 of the second fin 20, the first portion 11 of the first fin 10, and the second portion 12 of the first fin 10 are generally equal in longitudinal length to one another.

The second portion 22 is so positioned as to adjoin longitudinal one end of the first portion 21. Also, the second portion 22 is so positioned as to be slightly inclined with respect to the first portion 21. One corner at longitudinal one end of the first portion 21 and one corner at longitudinal one end of the second portion 22 are in contact with each other.

The second heat transfer tubes are inserted into the 2-row, 8-stage through holes 28 of the first portion 21 for insertion of heat transfer tubes, as well as into the 2-row, 8-stage through holes 29 of the second portion 22 for insertion of heat transfer tubes. More specifically, the second heat transfer tubes are so placed as to run through a plurality of second fins 20 arrayed at specified intervals in a thicknesswise direction of the second fins.

Also, as shown in FIG. 1, one-side edges 26, 27 of the main heat exchanger 9, which is long and narrow and bent at one place, are so positioned as to be in contact with one-side edges 16, 17 of the long-and-narrow, bent-at-one-place auxiliary heat exchanger 8 on one side on which the burrs 14, 15 are formed. More specifically, one edge 26 of the first portion 21 of the second fin 20 is in contact with the edge 16 of the first portion 11 of the first fin 10 on which the burrs 14 are present, while one edge 27 of the second portion 22 of the second fin 20 is in contact with the edge 17 of the second portion 12 of the first fin 10 on which the burrs 15 are present.

The edges 16, 17 having the burrs thereon are positioned inside, so that no burrs are present at outer-side edges of the heat exchanger. That is, burrs are present neither on an outer-side edge 30 of the first portion 11 of the first fin 10 nor on an outer-side edge 31 of the second portion 12 of the first fin 10. Also, burrs are present neither on an outer-side edge 40 of the first portion 21 of the second fin 20 nor on an outer-side edge 41 of the second portion 22 of the second fin 20.

Figure 2:
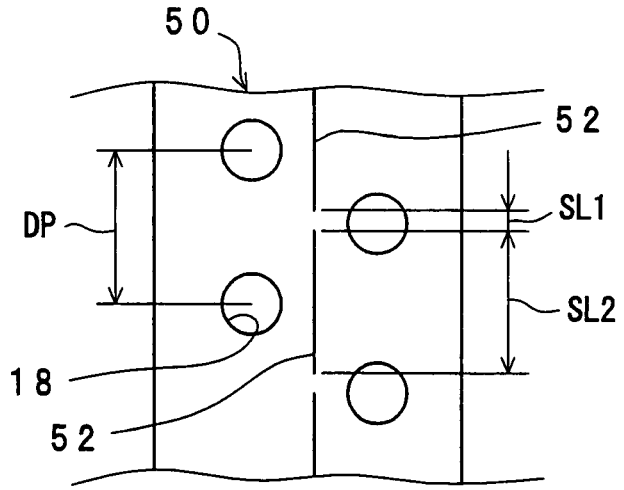
FIG. 2 is a view showing part of a perforated fin used to form a first fin included in the heat exchanger of the embodiment.

FIG. 2 is a view showing part of a perforated fin 50 used to form the first fin 10.

Referring to FIG. 2, reference numeral 18 denotes insertion holes for heat transfer tubes, and 52 denotes perforations (slits). Reference character DP denotes a distance between the through holes 18 adjacent to each other along a direction generally parallel to a direction in which the perforation extends, SL2 denotes a length of a perforation (slit), and SL1 denotes a connection part of the perforations.

The perforated fin 50 is formed of a plate member having a generally rectangular-shaped surface. The perforations 52 are formed at a generally widthwise center of the perforated fin 50. The perforations 52 extend generally parallel to the longitudinal direction of the perforated fin 50. The first fin 10 shown in FIG. 1 is formed by dividing the perforated fin 50 at its portion where the perforations are formed. From the perforated fin 50 shown in FIG. 2, two first portions 11 of the first fin 10 are formed, or two second portions 12 of the first fin 10 are formed, or one first portion 11 and one second portion 12 of the first fin 10 are formed.

There is a relationship shown by the following Equation (1) among DP, SL2 and SL1. The size of the connection part SL1 of the perforations is limited to a range shown by the following Equation (2). Limiting the size of the connection part SL1 of the perforations to the range shown by Equation (2) prevents the perforated fins from becoming lower in strength than a specified strength, and also allows the perforated fins to be easily divided at the perforation.

$$SL2=DP-SL1 \quad (1)$$

$$0.15\ (\text{mm})<SL1<0.5\ (\text{mm}) \quad (2)$$

Figure 3A:
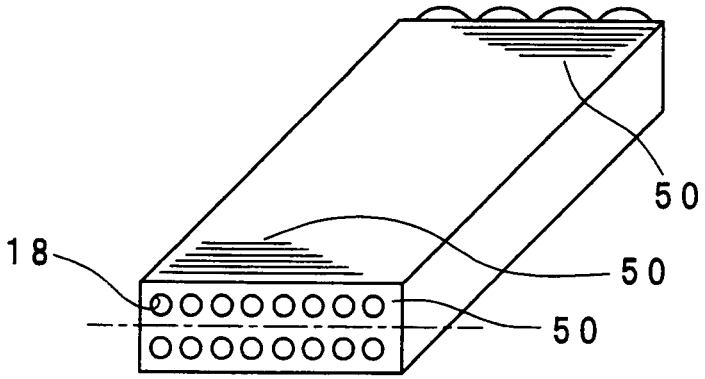
FIG. 3A is a view showing manufacturing process of a first portion or a second portion of the first fins included in the heat exchanger of the embodiment.
Figure 3B:
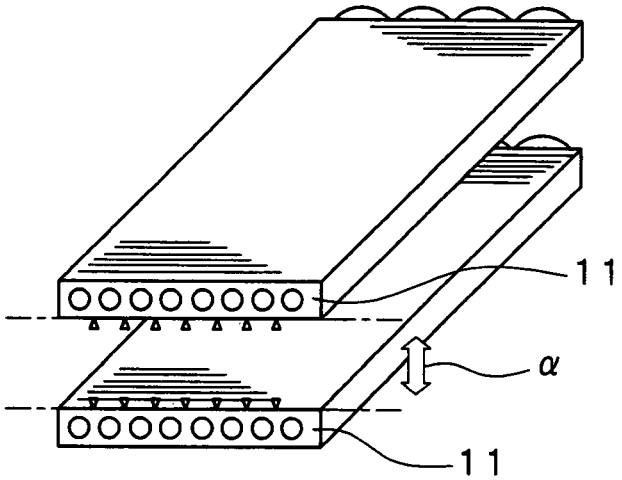
FIG. 3B is a view showing manufacturing process of a first portion or a second portion of the first fins included in the heat exchanger of the embodiment.
Figure 3C:
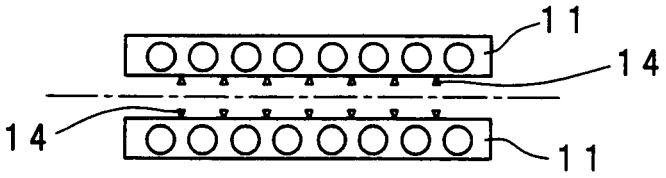
FIG. 3C is a view showing manufacturing process of a first portion or a second portion of the first fins included in the heat exchanger of the embodiment.

FIGS. 3A to 3C are views showing manufacturing process of the first portions 11 or the second portions 12 of the first fins shown in FIG. 1. A method for manufacturing the first portions 11 or the second portions 12 shown in FIG. 1 are, described below with reference to FIGS. 3A to 3C. In FIG. 3A, reference numeral 50 denotes the perforated fin shown in FIG. 2. In the perforated fin 50, whereas the heat transfer tube insertion holes 18 are actually disposed in a staggered arrangement as shown in FIG. 2, the insertion holes are disposed in a lattice arrangement for simplicity in FIGS. 3A to 3C (actually, in a staggered arrangement).

First, a plurality of above-described perforated fins 50 of the same configuration are disposed at equal intervals along the thicknesswise direction of the perforated fins 50 so that the perforated fins 50 are piled up. Then, in this state, pins or other rod-like members (not shown) are inserted through some (two or more) of a plurality of heat transfer tube insertion holes 18 that are formed at the same positions of the plurality of piled-up perforated fins 50, so as to extend through the plurality of piled-up perforated fins 50. Thus, the state in which the plurality of perforated fins 50 shown in FIG. 1 are piled up is maintained.

Next, a force is applied along a direction shown by arrow a in FIG. 3B. More specifically, a force is applied in such a direction that two parts of the perforated fins 50 shown in FIG. 3A bordered by a line on which the perforations are formed are separated away from each other. This force is exerted, for example, by applying a force along the widthwise direction of the perforated fins 50 in such a way that one part on one side bordered by the perforations of the perforated fins 50 is fixed while the other part bordered by the perforations is separated from the above-mentioned one side. Then, a force is applied to the perforated fins 50 in the direction shown by the arrow a in FIG. 3B so that the perforated fins 50 are divided into two by the line on which the perforations are formed as shown in FIG. 3B, by which the first portions 11 (or second portions 12) are formed.

As a result of the formation of the first portions 11 by such a method, the manufacturing cost for the first portions 11 (or second portions 12) can be reduced. Also, burrs 14 are formed at places of the first portions 11 corresponding to the connection parts of the perforations of the perforated fins 50 as shown in FIG. 3C. However, with an arrangement that the edge of one fin with burrs present thereon is positioned so as to be in contact with or opposition to the edge of another fin, and that the edge with burrs present thereon is positioned inside, as in the heat exchanger of the embodiment shown in FIG. 1, such problems as scattering of condensed water or degradation of the appearance can be solved.

In the heat exchanger of this embodiment, the edges 16, 17 having the burrs 14, 15 present thereon and formed on one side of the first fins 10 are placed in contact with the edges 26, 27 of the second fins 20, and the edges 16, 17 having the burrs 14, 15 and formed in the heat exchanger are positioned inside. Therefore, the burrs 14, 15 are present only on the edges 16, 17 that are in contact with or opposition to the second fins 20, and not on the edges 30, 31, among the edges 16, 17, 30, 31 of the first fins 10, and moreover the burrs 14, 15 are present only on the edges 26, 27 that are in contact with or opposition to the first fins 10, and not on the edges 40, 41, among the edges 26, 27, 40, 41 of the second fins 20.

Consequently, even if condensed water has scattered from the edges 16, 17 having the burrs 14, 15 present thereon, the scattered condensed water can be received by the edges 26, 27 in contact with or opposition to the edges 16, 17 having the burrs 14, 15 present thereon. Thus, since condensed water can be prevented from scattering outward along with winds, the heat exchanger of the embodiment, even when used as a heat exchanger on the indoor side of an air conditioner, can be kept from indoor scattering of the condensed water mixed in winds.

Also, in the heat exchanger of this embodiment, no burrs are present on the edges 30, 31 other than the edges 16, 17 that are in contact with or opposition to the second fins 20 among the edges 16, 17, 30, 31 of the first fins 10, and moreover no burrs are present on the edges 40, 41 other than the edges 26, 27 that are in contact with or opposition to the first fins 10 among the edges 26, 27, 40, 41 of the second fins 20. Therefore, the burrs 14, 15 having burrs present thereon are never positioned on the outer side of the heat exchanger. Thus, according to the heat exchanger of this embodiment, the appearance of the heat exchanger is not impaired.

In the heat exchanger of this embodiment, burrs are formed on the edges 16, 17 being in contact with the second fins 20 among the edges 16, 17, 30, 31 of the first fins 10. However, in this invention, burrs may also be formed on edges of the first fins that are opposed to the second fins with a specified distance provided between the first fins and the second fins.

Also, in the heat exchanger of this embodiment, burrs are formed only on the edges 16, 17 that are in contact with the second fins 20 among the edges 16, 17, 30, 31 of the first fins 10. However, in this invention, it is also possible that burrs are formed on edges of the first fins that are in contact with or opposition to the second fins while burrs are formed on edges of the second fins that are in contact with or opposition to the first fins. Furthermore, it is also possible that burrs are formed only on edges of the second fins that are in contact with the first fins.

Also, in the heat exchanger of this embodiment, 1-row, 16-stage insertion holes for heat transfer tubes are formed in the first fins 10, and moreover 2-row, 16-stage insertion holes are formed in the second fins 20. However, in this invention, the arrangement of the insertion holes for heat transfer tubes to be formed in the first fins is not necessarily limited to the 1-row, 16-stage arrangement, and any arrangement may be adopted. Similarly, the insertion holes for heat transfer tube to be formed in the second fins are not necessarily limited to the 2-row, 16-stage arrangement, and any arrangement may be adopted.

Also, in the heat exchanger of this embodiment, the insertion holes 28 are provided in a staggered arrangement in the second fin 20. However, in the fins of this invention, the insertion holes may be provided either in a staggered arrangement or in a lattice arrangement or in any other arrangement.

Further, in the heat exchanger of this embodiment, the first fin 10 of the auxiliary heat exchanger 8 serving as the first heat exchanger section is composed of two portions, the first portion 11 and the second portion 12, while the second fin 20 of the main heat exchanger 9 serving as the second heat exchanger section is composed of two portions, the first portion 21 and the second portion 22. However, for this invention, it is also possible that at least one of the first fin and the second fin is made up of one portion or three or more portions.

Further, in the heat exchanger of this embodiment, two heat exchanger sections (auxiliary exchanger 8 and main heat exchanger 9) are so positioned that their edges are in contact with each other, and burrs are disposed on the inner side. However, in this invention, it is of course possible that three or more heat exchanger sections are positioned so that edges of adjacent heat exchanger sections are in contact with or opposition to each other, where burrs are formed only in the inner side.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heat exchanger of an air conditioner, comprising:

a first heat exchanger section having plate-shaped first fins, and a plurality of first heat transfer tubes inserted through the first fins so as to extend along a thicknesswise direction of the first fins, the first fins each having a first lateral edge and a second opposed lateral edge; and a second heat exchanger section having plate-shaped second fins, and a plurality of second heat transfer tubes inserted through the second fins so as to extend along a thicknesswise direction of the second fins, the second fins each having a first lateral edge and a second opposed lateral edge, wherein the first heat exchanger section and the second heat exchanger section are positioned with the first lateral edges of the first fins in opposition to the first lateral edges of the second fins, a plurality of spaced apart burrs are provided on at least one of the first lateral edge of the first fins and the first lateral edge of the second fins, no burrs are provided on the second lateral edge of the first fins, no burrs are provided on the second lateral edge of the second fins, and all of the burrs are sandwiched between the first heat exchanger section and the second heat exchanger section.

2. A heat exchanger of an air conditioner according to claim 1, wherein heat transfer tubes are inserted through holes in the fins, and a distance between the burrs adjacent to each other is equal to a distance between the holes adjacent to each other.

3. The heat exchanger of an air conditioner according to claim 1, wherein the first lateral edges of the first fins form a first side of the first heat exchanger section, the first lateral edges of the second fins form a first side of the second heat exchanger section, and the entirety of the first side of the first heat exchanger section is in opposition to the entirety of the first side of the second heat exchanger section.

4. The heat exchanger of an air conditioner according to claim 3, wherein the first side of the first heat exchanger section has a length substantially equal to the length of the first side of the second heat exchanger section.

5. The heat exchanger of an air conditioner according to claim 3, wherein the first side of the first heat exchanger section is substantially straight, and the first side of the second heat exchanger section is substantially straight.

6. The heat exchanger of an air conditioner according to claim 1, wherein the plurality of space apart burrs are provided along an entirety of the first lateral edge.

7. The heat exchanger of an air conditioner according to claim 6, wherein the entirety of the first edge of the first fins is in opposition to the entirety of the first edge of the second fins.

8. The heat exchanger of an air conditioner according to claim 1, wherein the length of the first lateral edge of the first fins is substantially equal to the length of the first lateral edge of the second fins.

9. A heat exchanger, comprising:

a first heat exchanger section including plate-shaped first fins, a plurality of first heat transfer tubes inserted through the first fins so as to extend along a thicknesswise direction of the first fins, and a plurality of burrs present at a specified interval on a first lateral edge of the first fins; and a second heat exchanger section including plate-shaped second fins physically separated from the first fins, and a plurality of second heat transfer tubes inserted through the second fins so as to extend along a thicknesswise direction of the second fins, wherein the first heat exchanger section and the second heat exchanger section are positioned adjacent to each other with the plurality of burrs in contact with a first lateral edge of the second fins, no burrs are provided on a second lateral edge of the first fins, no burrs are provided on a second lateral edge of the second fins, and all of the burrs are sandwiched between the first heat exchanger section and the second heat exchanger section.

10. The heat exchanger according to claim 9, wherein a plurality of burrs are present at specified intervals on the first edge of the second fins, and the first heat exchanger section and the second heat exchanger section surround the plurality of burrs on the first fins and the plurality of burrs on the second fins.

11. The heat exchanger according to claim 10, wherein the plurality of burrs present on the first edges of the first fins are in opposition to the plurality of burrs present on the first edges of the second fins.

* * * * *